United States Patent [19]

Dodonov

[11] 4,288,721

[45] Sep. 8, 1981

[54] MICROWAVE MAGNETRON-TYPE DEVICE

[76] Inventor: Jury I. Dodonov, Profsojuznaya ulitsa, 93, korpus 2, kv. 384, Moscow, U.S.S.R.

[21] Appl. No.: 50,553

[22] Filed: Jun. 20, 1979

[51] Int. Cl.[3] ..... H01J 25/50

[52] U.S. Cl. ..... 315/39.51; 315/39.67; 315/39.75; 331/86

[58] Field of Search ..... 315/39.51, 39.53, 39.69, 315/39.75; 331/56, 86

[56] References Cited

U.S. PATENT DOCUMENTS

| | | | |
|---|---|---|---|
| 2,496,500 | 2/1950 | Spencer | 315/39.51 |
| 2,817,789 | 12/1957 | Steimel | 315/39.53 |
| 3,027,488 | 3/1962 | Winsor | 315/39.69 X |
| 3,045,147 | 7/1962 | Butler | 315/39.69 |
| 4,028,583 | 6/1977 | Bigham | 315/39.69 |

FOREIGN PATENT DOCUMENTS

| | | | |
|---|---|---|---|
| 494093 | 5/1977 | U.S.S.R. | 315/39.51 |

*Primary Examiner*—Saxfield Chatmon, Jr.
*Attorney, Agent, or Firm*—Robert E. Burns; Emmanuel J. Lobato; Bruce L. Adams

[57] ABSTRACT

A microwave magnetron-type device comprises an anode assembly or block in the form of a multistage two-dimensional periodic retarding system, including cavities with vanes, each having a lumped inductance portion defined by the vane sidewalls near the vane bases, and straps. The straps are arranged on each stage of the retarding system and pass through windows made in the vanes. Provided in the inductive portion of the cavities of the retarding system is at least one duct with the following ratios:

$$d_1 > d_2 > d_3,$$

$$d_3 > d_4 > d_5,$$

$$h_1 \leq h_2,$$

where $d_1$ is the distance between the vane ends and the outer surface of the anode assembly, $d_2$ is the distance between the vane ends and the duct wall adjacent to the outer surface of the anode assembly, $d_3$ is the distance between the vane ends and the wall of the inductive portion of the cavities, remotest from the vane ends, $d_4$ is the distance between the vane ends and the opposite duct wall, $d_5$ is the distance between the vane ends and the window wall on the side of the vane ends, $h_1$ is the height of the duct between two stages of the retarding system, and $h_2$ is the distance between adjacent stages of the retarding system.

5 Claims, 5 Drawing Figures

MICROWAVE MAGNETRON-TYPE DEVICE

FIELD OF THE INVENTION

The present invention relates to microwave vacuum-tube engineering, and more particularly to microwave magnetron-type devices.

The invention can most advantageously be used in high-power (microwave) electronics, particularly in industrial microwave ovens. In addition, the invention is applicable to preheating plasma and thermonuclear fusion, which is of particular importance in view of the problem of obtaining a new type of fuel.

BACKGROUND OF THE INVENTION

At present, the development of high-power microwave electronics is aimed at maximizing the pulse and continuous (or average) power output, as well as the pulse energy. The power output of microwave devices, and more specifically magnetron-type microwave devices, is limited by the properties of the materials of the cathode, anode and dielectric output window, their ability to withstand and dissipate electrical and thermal loads, as well as by the electronic efficiency.

These limitations are obviated as follows: by increasing the electronic efficiency, by using special materials with improved emission properties for cathodes, materials featuring high electrical and heat conductance for anodes and cathodes, materials with maximum tolerance to thermal loads for anodes, and materials with low dielectric loss and high microwave carrying capacity for output windows, etc.

However, the properties of materials have certain physical limitations as far as maximum permissible thermal and electrical loads are concerned, therefore further increases in the microwave generation power are possible only through enhancing the electronic efficiency and enlarging the working surfaces of the electrodes—both the anode and cathode. This possibility of increasing power is illustrated by the following formula for the limiting average (or continuous) power output of a microwave magnetron-type device:

$$P = qS(\eta_e/1-\eta_e), \quad (1)$$

where P is the limiting average (or continuous) microwave power output;

q is the maximum permissible specific load on the anode;

S is the working surface of the anode;

$\eta_e$ is the electronic efficiency.

Since the electronic efficiency of microwave magnetron-type devices may be high (90% and higher), with the maximum attainable electronic efficiency the only parameters that can be varied to further improve the microwave power output are the surface of the anode (as well as the cathode) and the maximum permissible specific load on the anode. When the maximum specific loads are attained, only one variable parameter is left—the anode surface.

In microwave devices of the magnetron type, the working surfaces of the electrodes, cathode and anode, are enlarged by increasing their radial and axial dimensions (if the anode assembly or block is cylindrical in shape). Larger working surfaces mean greater mass of the device. Low-power microwave magnetron-type devices are rather compact, and the ratio of mass M of the device to its power P is sufficiently low ($M/P \sim 0.5$ to 1 kg/kW) and meets such design and performance criteria as low metal requirements, stability to mechanical damage in manufacture and handling, low cost, etc.

In the case of high- and, especially, extremely high-power microwave magnetron-type devices, the problem of weight and size attains primary importance and, in some instances, when there are such physical limitations as yield of the material, which does not provide for the desired stability of shape in heavy devices, the weight and size are the determining factors in creating a microwave device with a required power output.

Despite the fact that the ratio of mass to microwave power output (M/P) in such devices is approximately the same as in low-power devices, and in some cases even somewhat lower, the absolute value of mass increases with the working surface of the anode assembly.

At the same time, increasing the size and weight (mass) of a microwave magnetron-type device with a view to enhancing its power output means to increase the size and weight of the magnets creating the magnetic field in the device. All this leads to serious difficulties in developing devices with high power output.

The problem is further aggravated when the wavelength of the generated microwaves is increased. The bulk of the anode assembly in microwave magnetron-type devices containing a multicavity retarding system is occupied by cavities whose dimensions determine the length of the generated microwaves. In order to ensure maximum electronic efficiencies of the device as a whole ($\eta$) and individual cavities ($\eta_n$), the intrinsic Q factor ($Q_o$) of the latter must be as high as possible, which can be inferred from formula:

$$\eta = \eta_e \cdot \eta_n = \eta_e (1 - Q_n/Q_o) \quad (2)$$

where $\eta$ is the electronic efficiency of a microwave magnetron-type device, $\eta_e$ is the electronic efficiency of energy transformation, $\eta_n$ is the electronic efficiency of individual cavities of the retarding system of the device, $Q_n$ is the loaded Q factor of the retarding system of the device, $Q_o$ is the intrinsic Q factor of the retarding system cavities.

Since the intrinsic Q factor $Q_o$ of the cavities is, in turn, directly dependent on the volume of their inductive part, the size and weight (mass) of a microwave device is largely dependent on the construction of the inductive part of the cavities.

It should be pointed out that the intrinsic Q factor of the cavities also determines other characteristics of a microwave device, particularly the stability of its operation.

The fabrication of microwave magnetron-type devices also involve manufacturing and economical problems. Namely, each time when a device generating microwave power at a given frequency has to be made, it is necessary to fabricate a rather complex tool, e.g. a punch, for imparting the cavities of the retarding system a shape corresponding to that frequency. This considerably complicates the process of manufacturing new devices and increases its cost, particularly when the operation of the device must be extremely accurate at a strictly defined resonance frequency (or within a frequency band) and when a broad frequency band has to be covered by several almost identical devices of standardized design.

Known in the art is a microwave magnetron-type device comprising an anode assembly with a retarding system made up of cavities with Z-shaped segments or vanes, as well as straps. The straps are electrically associated with respective vanes of cavities of the same polarity in the pi-mode (cf. U.S. Pat. No. 2,953,715; Cl. 315-39.75; Sept. 20, 1960).

In this device, the cavity vanes being Z-shaped does not permit substantially increasing the axial dimensions of the anode assembly in order to enhance the power output because the dimensions of the cavity vanes along the height of the anode assembly or anode block exceed the axial dimensions of the working part of the anode assembly.

Thus, in the prior art design, the reduction of the diameter of the cylindrical anode assembly results in a greater height thereof without increasing the anode surface, hence, the generating power. Therefore, no gain is achieved by reducing the size and weight.

In addition, in the above microwave magnetron-type device, the anode assembly and its retarding system cannot be made strong and stable in shape, particularly in the case of a large anode assembly. This is due to the fact that the point of attachment of a vane to the anode assembly is relatively far from the vane's center of gravity, and without additional support the vanes may bend.

Also known is a microwave magnetron-type device comprising an anode assembly in the form of a multistage two-dimensional periodic retarding system, including cavities with vanes each having a lumped inductance portion defined by the vane sidewalls near the vane bases or roots, and straps. The straps are arranged on each stage of the retarding system and pass through windows made in each of the vanes. The device also comprises a cathode arranged spaced a distance from free ends of the vane.

In this microwave device, the anode assembly is cylindrical in shape, the height of the cylinder is greater than a quarter of the generated wavelength $\lambda$, while the distance between adjacent stages of the retarding system, i.e. the distance between adjacent double straps, does not exceed $\lambda/6$, which provides for some increase in the generated power level.

However, this entails not only a larger size of the device but also a greater mass thereof. The larger size and mass are primarily due to the necessity to increase not only the axial dimensions of the cylindrical anode block or assembly but also its diameter. This is caused by the fact that the larger axial dimensions of the anode assembly, i.e. its height, result in lower inductance L thereof, due to the inductance being inversely proportional to the anode height.

The presence of straps, increasing their number and the total capacitance with the height of the anode assembly, result in some increase in the wavelength $\lambda$ of the generated microwaves, but the efficiency of the device drops because of the lower intrinsic Q factor $Q_o$ of the retarding system.

This calls for increasing the inductance of the cavities and decreasing the total capacitance with a constant wavelength of the retarding system of the anode assembly by increasing the volume of the cavities in their inductive portion. Normally, this can be done in a cylindrical anode assembly by increasing the transverse dimensions of the cavities, which results in a greater diameter of the anode assembly as a whole.

The same applies to the case where the wavelength $\lambda$ of the generated microwaves has to be increased. To this end, either the number of straps and the height of the anode assembly are increased, or the radial dimensions of the cavities and the anode assembly, or both.

Thus, the above construction of a microwave magnetron-type device does not permit reducing the mass and weight of the latter, both when the working surface of the anode assembly is extended to increase the generated microwave power output of the device and when the wavelength is increased to extend the application of such microwave devices to the long-wave region of the microwave range.

Besides, the above design of a microwave magnetron-type device does not permit standardizing devices intended to perform similar functions over a broad microwave frequency range.

SUMMARY OF THE INVENTION

It is an object of the present invention to reduce the size and weight of a microwave magnetron-type device with an increased wavelength of the generated microwaves.

This object is attained in a microwave magnetron-type device comprising an anode assembly or anode block in the form of a multistage two-dimensional periodic retarding system, including cavities with vanes, each having a lumped inductance portion defined by the vane sidewalls near the vane roots or bases, straps arranged on each stage of the retarding system and passing through windows made in each of the vanes, and a cathode arranged at a distance from the vane ends, according to the invention, provided in the inductive portion of the cavities of the retarding system is at least one duct with the following ratios:

$$d_1 > d_2 > d_3, \quad (3)$$

$$d_3 > d_4 > d_5, \quad (4)$$

$$h_1 \leqq h_2, \quad (5)$$

where $d_1$ is the distance between the vane ends and the outer surface of the anode assembly, $d_2$ is the distance between the vane ends and the duct wall adjacent to the outer surface of the anode assembly, $d_3$ is the distance between the vane ends and the wall of the inductive portion of the cavities, remotests from the vane ends, $d_4$ is the distance between the vane ends and the opposite duct wall, $d_5$ is the distance between the vane ends and the window wall on the side of the vane ends, $h_1$ is the height of the duct between the two stages of the retarding system, $h_2$ is the distance between adjacent stages of the retarding system.

The duct should preferably be made between two stages of the retarding system.

It is expedient that the duct be made on the level of a retarding system stage so that the distance $d_4$ exceeds a distance $d_6$ between the free ends of each vane and the window wall on the side of the outer surface of the anode assembly.

In the proposed microwave magnetron-type device, the weight and size of the anode assembly are reduced with an increased wavelength of the generated microwaves, and the ratio of the device's weight to its power output is decreased without affecting the working surface of the anode assembly $$\left(\frac{M}{P} < 0.5\frac{kg}{RW}\,k\,v\right)$$

Therewith, the intrinsic Q factor of the retarding system is increased, which results in a higher efficiency of the device and cuts down the cost of production of anode block assemblies for many devices of a standardized design within a broad frequency range, particularly in the longwave region of the microwave range. The reduced weight of the microwave magnetron-type device makes it possible to further extend the working surface of the anode assembly with a multistage two-dimensional periodic retarding system and to increase the microwave power output.

BRIEF DESCRIPTION OF THE DRAWINGS

The invention will now be described in greater detail with reference to specific embodiments thereof, taken in conjunction with the accompanying drawings, wherein.

DETAILED DESCRIPTION OF THE INVENTION

In the following description, the proposed microwave magnetron-type device is essentially a magnetron oscillator which will be referred to, for brevity, as a magnetron.

Figure 1:
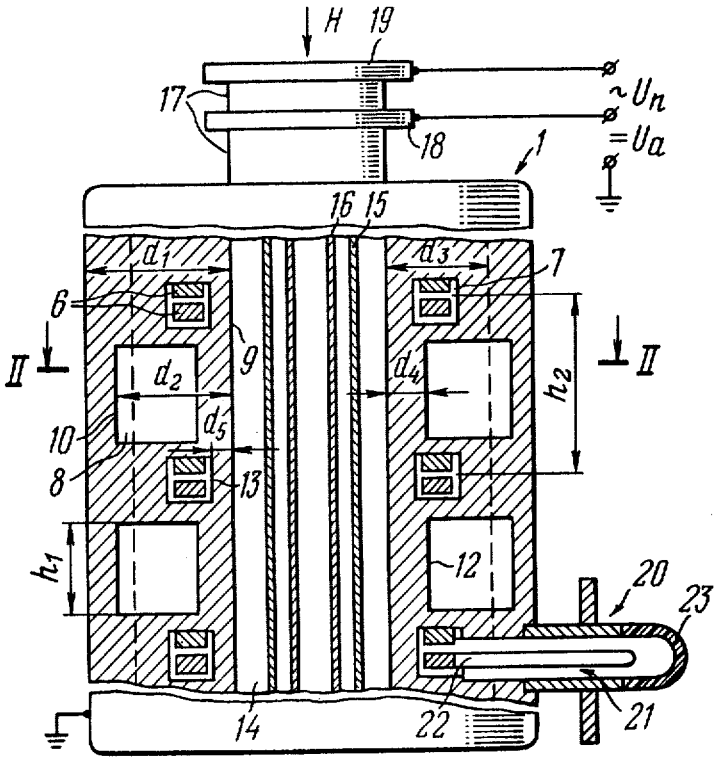
FIG. 1 is a partially cut out view of a microwave magnetron-type device with annular ducts provided between retarding system stages, according to the invention.
Figure 2:
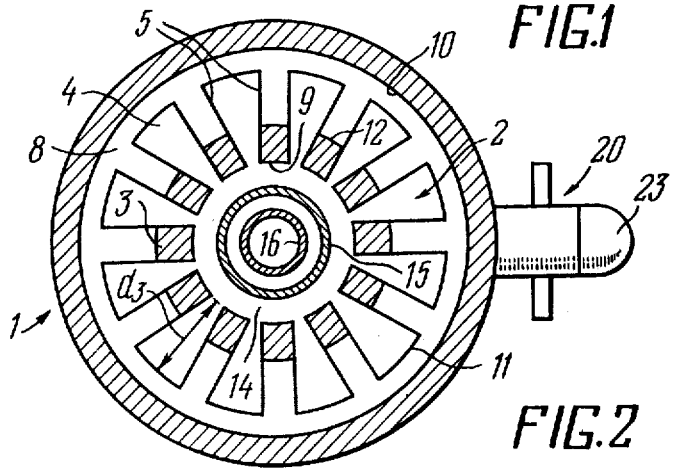
FIG. 2 is a cross-sectional view taken along line II—II of FIG. 1, according to the invention.

The magnetron comprises a vacuum-tight cylindrical anode assembly 1 (FIG. 1) made as a multistage two-dimensional periodic retarding system including a plurality of series-connected cavities 2 (FIG. 2) (in this embodiment, of the sector type) with vanes 3. The cavities 2 each have, an inductive portion 4 defined by walls 5 of the vanes 3 near their bases. The retarding system also includes double straps 6 (FIG. 1) arranged on each stage of the retarding system and passing through windows 7 made in the vanes 3. Provided in the inductive portion 4 of the cavities 2 of the retarding system are ducts 8 with the following ratios:

$$d_1 > d_2 > d_3,$$

$$d_3 > d_4 > d_5,$$

$$h_1 \leqq h_2,$$

where $d_1$ is the distance between the ends 9 of the vanes 3 and the outer surface of the anode assembly 1, $d_2$ is the distance between the ends 9 of the vanes 3 and a wall 10 of a duct 8, adjacent to the outer surface of the anode assembly 1, $d_3$ is the distance between the ends 9 of the vanes 3 and a wall 11 of the inductive portion 4 of the cavities 2, remotest from the ends 9 of the vanes 3, $d_4$ is the distance between the ends 9 of the vanes 3 and an opposite wall 12 of the duct 8, $d_5$ is the distance between the ends 9 of the vanes 3 and a wall 13 of the window 7, on the side of the ends 9 of the vanes 3, $h_1$ is the height of the duct 8 between two stages of the retarding system, and $h_2$ is the distance between adjacent retarding system stages.

In this embodiment of the magnetron, the ducts 8 (FIG. 1) are provided between every stage of the retarding system. The ducts 8 may be of any shape in the longitudinal section of the magnetron (in this case, rectangular) and may be arranged in any desired combination between two, several or all stages of the retarding system depending on specific requirements, particularly when the wavelength of the generated microwaves has to be increased or decreased.

Arranged in the anode assembly or block 1, at a distance from the free ends 9 (FIG. 2) of the vanes 3 forming an anode opening 14, are a cathode 15 with a heater 16, coaxial with an opening or central chamber 14. In this embodiment, a cathode 15 and heater 16 are essentially coaxial metal tubes attached to the anode assembly 1 by means of evacuated cermet insulators 17 (FIG. 1) provided with terminals 18 and 19 for the device to be connected to sources $U_h$ and $U_a$ of the heater current and anode voltage, respectively. The housing of the anode assembly 1, which is at positive potential $U_a$, is grounded.

An output coupling device 20 in the embodiment under consideration is made as a coaxial line 21 electrically associated via a conductive coupling element 22 with one of the straps 6 of the multistage two-dimensional periodic retarding system and has a dielectric output window 23.

Figure 3:
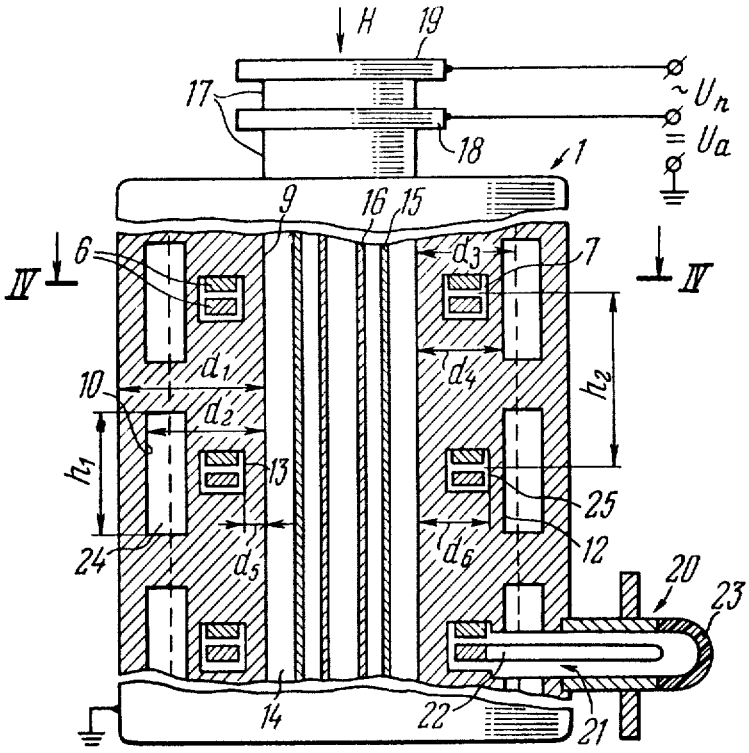
FIG. 3 is a partially cut out view of the microwave magnetron-type device of FIG. 1 with annular ducts provided on retarding system stages, according to the invention.

Shown in FIG. 3 is an embodiment of the magnetron, wherein ducts 24 are provided on retarding system stages (in this case, on each stage) so that the distance $d_4$ exceeds distance $d_6$ between the free ends 9 of the vanes 3 and a wall 25 of the window 7, on the side of the outer surface of the anode assembly 1. In this embodiment, the ducts 24 may also be of any shape and arranged in the anode assembly 1 in any combination.

Figure 4:
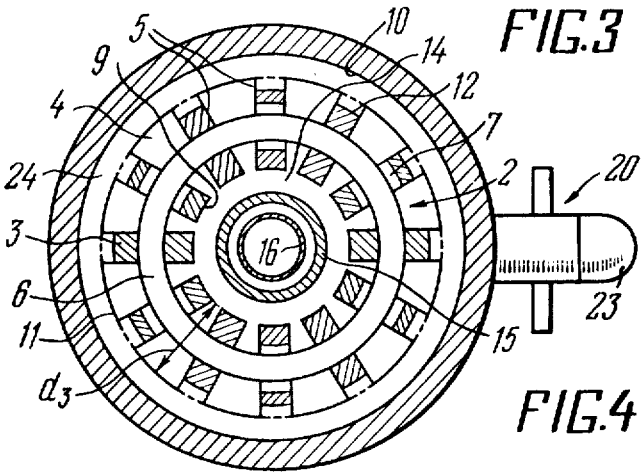
FIG. 4 is a cross-sectional view taken along line IV—IV of FIG. 3.

FIG. 4 illustrates the mutual arrangement of the straps 6 and ducts 24 on one of the retarding system stages, as well as the electrical connection of the straps 6 to the vanes 3 of the same polarity in the pi-mode.

The above ducts may also be provided in the inductive portion of the cavities of a planar anode assembly which is essentially an open multistage two-dimensional periodic retarding system. Such an embodiment, however, is less preferable.

The proposed microwave magnetron-type device operates as follows.

The cathode 15 (FIGS. 1 and 3) arranged in the center of the anode opening 14 of the vacuum-tight anode assembly 1 is heated to a required temperature with the aid of the electric heater 16 from the source $U_h$ of the alternating or direct heater current. The electrons emitted by the cathode 15 into the interaction space defined by the ends 9 (FIGS. 2 and 4) of the vanes 3 making up the anode are accelerated by the electric field created by the source $U_a$ of d-c anode voltage between the cathode 15 and the anode of the device. The anode voltage $U_a$ is supplied from the source through a grounded-anode circuit. In the presence of a magnetic field H shown by the arrow in FIGS. 1 and 3, directed along the axis of the anode assembly 1, the electrons excite, at a certain magnitude of the anode voltage $U_a$, high-frequency oscillations in the retarding system of the device through the gaps between the ends 9 of adjacent vanes 3. The high-frequency field created in these gaps bunches the electrons into beams which move, under the effect of the applied anode voltage $U_a$ and magnetic field H, along the anode surface synchronously with the excited retarded microwave-frequency wave in its retarding phase and transmit the power from the source $U_a$ to the microwave electromagnetic field. Thus, the power from the source $U_a$ is transformed to microwave energy. The latter is accumulated in the cavities 2 (FIGS. 2 and 4) of the retarding system of the microwave device. The multistage two-dimensional periodic retarding system of the anode assembly 1 is, in this case, in a resonant state corresponding to the mode the frequency whereof corresponds to the synchronous movement along the anode surface of the electron beam interacting with the electromagnetic wave of only that mode. The microwave magnetron-type device as disclosed herein functions as an oscillator (in self-excitation mode) in the longest wavelength $\pi_o$-mode. The device may also operate as an amplifier from an external control signal synchronizing high-frequency oscillations in the retarding system. The resonant wavelength of the microwaves generated by the device in an equivalent representation of the multistage two-dimensional periodic retarding system at the longest wavelength $\pi_o$-mode is primarily determined by the total capacitance and inductance of a single cavity 2 (FIGS. 2 and 4) of the retarding system, i.e.

$$\lambda = 2\pi\sqrt{LC}\ , \tag{6}$$

where C and L are, respectively, the equivalent capacitance and inductance of a respective cavity 2 of the retarding system.

Since the inductance of the cavities 2 of the retarding system is lumped, mainly, in the inductive portion 4, the high-frequency currents induced in the gaps between the ends 9 of the vanes 3 of the cavities 2 by the electron beam accumulate practically all of the high-frequency energy in these lumped inductance portions 4 of the cavities 2.

The annular ducts 8 and 24 (FIGS. 2 and 4) being provided in the inductive portion 4 of the cavities 2 in the proposed microwave magnetron-type device results in that part of the surface of the current-carrying walls is remote from the cavities 2. Therewith, the high-frequency currents flow along the remaining current-carrying walls of the inductive portions 4 of the cavities 2 and almost all of the high-frequency energy is stored in the region of the inductive parts of the cavities 2 with the remaining current-carrying walls and, partially, in the marginal region of the inner spaces of the ducts 8 and 24 (scattered magnetic fluxes of mutual induction). The ducts 8 and 24 (FIGS. 1 and 3) being arranged between or on retarding system stages is similar, in an equivalent representation, to decreasing the height $h_o$ of the inductive portion 4 of the cavities 2, hence, to increasing its inductance L since $L \sim 1/h_o$. Therewith, in the case where the ducts 8 are arranged between stages in the inductive portion 4 (FIGS. 1 and 2) of the cavities 2 of the retarding system, the mass (weight) of the anode assembly 1 can be reduced still more effectively. In this case, it becomes possible to shift the resonant wavelength of the generated oscillations not only to the long-wave region of the microwave range but also to the short-wave region, because when the dimension $d_4$ is reduced to a value closest to $d_5$, the capacitance between the vanes 3 of the cavities 3 is decreased.

Figure 5:
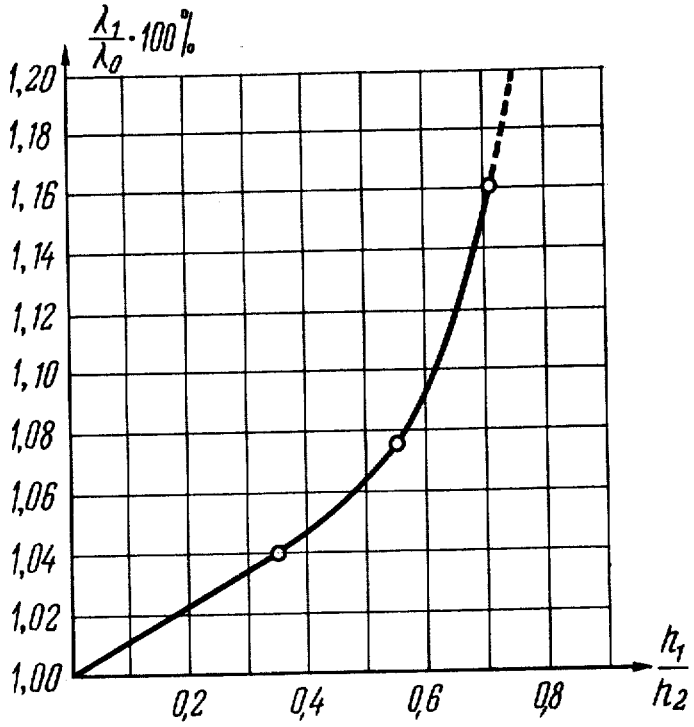
FIG. 5 is a graph showing the relative increase in the resonant wavelength of microwave-frequency waves versus relative variations in the duct height for the devices of FIGS. 1 through 4, according to the invention.

The ducts 8 and 24 being provided in the anode assembly 1 permits not only cutting down the weight and size of the device but also extending the long-wave region of the microwave frequency range. As the equivalent height $h_o$ of the inductive portion 4 (FIGS. 2 and 4) of the cavities 2 of the retarding system of the anode assembly 1 is decreased, particularly when the ratio of the duct height $h_1$ to the distance $h_2$ between adjacent retarding system stages approaches unity, the resonant wavelength $\lambda_1$ sharply increases, as can be seen from the graph of FIG. 5 for the magnetrons of FIGS. 1 through 4. Plotted on the abscissa is the ratio $h_1/h_2$, while plotted as ordinates is the percentage ratio of the resonant wavelength $\lambda_1$ with ducts 8 and 24 to the resonant wavelength $\lambda_o$ without ducts 8 and 24.

In an extreme case, where $h_1/h_2=1$, the resonator multistage two-dimensional periodic retarding system becomes a non-resonator one, i.e. a multiple-conductor line periodically loaded on the straps.

In addition, it should be noted that the intrinsic Q factor $Q_o$ of the cavities 2 of the retarding system increases, which leads to an increase in the efficiency of the device and stable generation in the operating $\pi_o$-mode.

The generated power of high frequency oscillations at the resonant wavelength is withdrawn from the retarding system of the anode assembly 1 (FIGS. 1 and 3) through the conductive coupling device 22 connected to one of the straps 6 of the retarding system. Then, the generated power is delivered through the coaxial line 21 to a net high-frequency load (not shown) through the dielectric output window 23.

The design features and improvements of the proposed microwave magnetron-type device provide a novel multistage two-dimensional periodic retarding system with modified cavities in the inductive portions whereof ducts are provided, increasing the inductance of the cavities without increasing the size and weight of the anode assembly.

This, in the proposed microwave magnetron-type device, the weight and size of the anode assembly are reduced, while the wavelength of the generated microwaves is increased and the ratio of the mass M of the device to the power output P of the generated microwaves is improved ($M/P<0.5$).

The weight and size of the multistage two-dimensional periodic retarding system in the proposed microwave magnetron-type device being reduced permits extending the working surface of the anode assembly to increase the power output of the device, and the higher intrinsic Q factor of the cavities permits improving the efficiency of such a device.

In addition, ducts being provided in the inductive portion of the cavities of the retarding system of the anode assembly enables low-cost manufacture of anode assemblies and standardization of devices over a broad frequency range, particularly in the long-wave region of the microwave range.

What is claimed is:

1. A magnetron comprising, an anode block comprising a multistage two-dimensional periodic retarding system and having a cylindrical central chamber, a cathode in said central chamber coaxial therewith, said anode block having a plurality of paired solid vanes disposed laterally spaced in a circumferential direction and extending inwardly of said chamber toward said cathode with the pairs thereof defining a plurality of resonator cavities, each vane having a root end and a free end terminating at said central chamber spaced outwardly from said cathode and having substantially flat sidewalls defining said resonator cavities, each cavity diverging from the free ends of the paired vanes toward the root ends thereof, each of said resonator cavities having a distributed inductance portion adjacent said root ends, said vanes having through windows on each stage of said retarding system, each of said through windows having a sidewall closer to the root end of a corresponding vane and an opposite sidewall closer to the free end of the corresponding vane, coaxial paired straps extending through the windows transversely of the vanes and each connected to a different group of alternate vanes, each of said vanes having an opening aligned with an opening of the adjacent vane to define a duct extending through all of the vanes in the vicinity of the distributed inductance portions thereof, and the magnetron having a frequency range including the long-wave range of the microwave frequency range greater than if the vanes did not have the aligned openings.

2. A magnetron according to claim 1, in which said duct has a first wall adjacent a root wall of a corresponding resonator cavity and a second wall opposite said first wall and in which said duct has the following ratios $$d_1 > d_2 > d_3,$$

$$d_3 > d_4 > d_5,$$

$$h_1 \leqq h_2,$$

wherein $d_1$, is a distance between the free end of each of said vanes to said outer surface of said anode block, $d_2$ is a distance between said free ends of each of said vanes and said first wall of said duct, $d_3$ is a distance between said free ends of each of said vanes and a root wall of a corresponding resonator cavity, $d_4$ is a distance between said free ends of each of said vanes and said second wall of said duct, $d_5$ is a distance between said free ends of each of said vanes and a wall with a lumped inductance portion adjacent the root wall, $h_1$ is a height of said duct between said two stages, and $h_2$ is a distance between adjacent stages of said retarding system.

3. A magnetron according to claim 2, in which said duct in which said distance $d_4$ exceeds a distance $d_6$ corresponding to a distance between the free end of said of said vanes and said first sidewall of said window.

4. A magnetron according to claim 1, in which said duct is disposed in one of said stages.

5. A magnetron according to claim 1, in which said duct is disposed between two of said stages.

* * * * *